US005233401A

United States Patent [19]

Sasaki et al.

[11] Patent Number: 5,233,401

[45] Date of Patent: Aug. 3, 1993

[54] TWO-SIDED PRINTING APPARATUS

[75] Inventors: Shigenori Sasaki; Hideyuki Nanba; Nobuo Fujita, all of Kawasaki, Japan

[73] Assignee: Fujitsu Limited, Kawasaki, Japan

[21] Appl. No.: 948,494

[22] Filed: Sep. 22, 1992

[30] Foreign Application Priority Data

Sep. 25, 1991 [JP] Japan ..... 3-245624

[51] Int. Cl.[5] ..... G03G 15/00

[52] U.S. Cl. ..... 355/319; 355/24; 271/186

[58] Field of Search ..... 355/319, 318, 309, 308, 355/24, 26; 271/186

[56] References Cited

U.S. PATENT DOCUMENTS

| | | | |
|---|---|---|---|
| 4,705,389 | 11/1987 | Maekawa et al. | 355/319 X |
| 4,835,567 | 5/1989 | Ogata | 355/318 |
| 4,935,786 | 6/1990 | Veeder | 355/319 |
| 4,975,738 | 12/1990 | Senma et al. | 355/314 X |
| 5,023,669 | 6/1991 | Hatano et al. | 355/319 |
| 5,132,719 | 7/1992 | Kioka et al. | 355/319 X |

FOREIGN PATENT DOCUMENTS

| | | | |
|---|---|---|---|
| 57-164746 | 10/1982 | Japan | 355/319 |
| 58-60763 | 4/1983 | Japan | 355/319 |
| 58-105249 | 6/1983 | Japan | 355/319 |
| 61-26061 | 2/1986 | Japan | 355/319 |
| 61-39077 | 2/1986 | Japan | 355/319 |
| 62-86384 | 4/1987 | Japan | 355/319 |

OTHER PUBLICATIONS

Abstract of Japanese Patent Document 3-67872, Document Published Mar. 22, 1991.

Abstract of Japanese Patent Document 63-171743, Document Published Jul. 15, 1988.

*Primary Examiner*—R. L. Moses

*Attorney, Agent, or Firm*—Staas & Halsey

[57] ABSTRACT

A two-sided printing apparatus includes a sheet feeding unit, an image printing unit, a sheet ejecting unit, and a sheet refeeding unit for refeeding a sheet having a first surface on which images have been printed to the image printing unit in order to print images on a second surface of the sheet. The sheet refeeding unit includes a base, an inclined frame rotatably fastened to the base, a first guide member facing the inclined frame, and a second guide member facing the base. The sheet moves downwards between the inclined frame and the first guide member and then moves between the base and the second guide member. The first guide member is rotatably supported so that the first guide member is raised and the inclined frame is lowered, a first space is formed between the lowered inclined frame and the raised first guide member. The second guide member is rotatably supported so that the second guide member is raised, a space is formed between the base and the second raised guide member.

16 Claims, 11 Drawing Sheets

TWO-SIDED PRINTING APPARATUS

BACKGROUND OF THE INVENTION

1. Field of the Invention

The present invention generally relates to a two-sided printing apparatus, and more particularly to an improvement in a sheet transport path for a two-sided print.

2. Description of the Prior Art

In a duplex printing apparatus, images are formed on one side of a recording sheet, such as paper, in an image transfer unit and are fixed in a fixing unit. Then the recording sheet is turned over, and refed to the image transfer unit. Thereafter, images are formed on the other side of the recording sheet, and are fixed in the fixing unit.

FIG. 1 shows a conventional two-sided printing apparatus, which comprises a photosensitive drum 1, around which are located an exposure position 2, a developing unit 3, an image transfer unit 4, a cleaner unit 5, and a uniform charger 6. When the entire width of the photosensitive drum 1 is charged by means of the uniform charger 6, and reaches the exposure position 2, an information light 8 deflected by an optical-system unit 7 is projected onto the exposure position 2, and hence an electrostatic latent image is formed on the photosensitive drum 1. Toner particles are adhered to the circumferential surface of the photosensitive drum 1 by means of the developing unit 3, so that a toner image is formed. The toner image is transferred to a sheet such as paper at the position of the image transfer unit 4. The cleaner unit 5 removes remaining toner particles and remaining charges from the photosensitive drum 1. The photosensitive drum 1 returns to the position of the uniform charger 6.

A sheet is fed from a sheet cassette 9, and transported to a pair of registration rollers 11 via a sheet path 10. Then, the sheet is positioned with respect to the toner image formed on the photosensitive drum 1, and is then transported to the image transfer unit 4. The image transfer unit 4 shown in FIG. 1 comprises a transfer charger. By means of a corona discharge, a charge having a polarity opposite to that of the toner image is applied to the sheet. Hence, the toner image on the photosensitive drum 1 adheres to the sheet.

The sheet to which the toner image has adhered is detached from the photosensitive drum 1 by means of a sheet detachment charger 12, and is then transported the fixing unit 13, in which the sheet is heated and the image is fixed on the sheet. That is a roller 13*a* of the fixing unit 13 on the side of the photosensitive drum 1 is a thermal roller in which a heater is installed. While the sheet to which the toner image adheres is passing between the thermal roller 13*a* and a pressure roller 13*b*, the sheet and the toner image are heated. Thereby, the toner image is melted and hardened, so that it is fixed on the sheet.

The sheet having the fixed toner image passes between an impeller 14 and an opposing roller 15 for sheet ejection when one-side print is to be performed. Then, the sheet is ejected to an ejection tray 19 by means of pairs 16, 17 and 18 of forward/reverse rollers located in an ejection transport path 24. In a two-sided print, the pairs 16, 17 and 18 of rollers are reversed when the rear end of the sheet has reached a position between the impeller 14 and the pair 16 of rollers. Thereby, the rear end of the sheet is guided between the impeller 14 and the pair 20 of rollers, and the sheet is transported to the registration rollers 11 by means of pairs 22 and 23 provided in a transport path 21 for back-surface printing.

During the above, the sheet is turned over, and transported between the fixing unit 4 and the photosensitive drum 1. When the sheet's back above-mentioned manner, a toner image on the photosensitive drum 1 is transferred to the back surface of the sheet. Then, the sheet is transported to the fixing unit 13 in which the image fixed. Thereafter, the sheet passes between the impeller 14 and the opposite roller 15, and is ejected to the ejection tray by means of the pairs 16, and 18 of rollers.

FIG. 2 is a diagram showing how a plurality of sheets are transported in the conventional two-sided printing apparatus shown in FIG. 1. S1 indicates a first sheet having a back surface on which an image is being printed. A second sheet S2 having a front surface on which an image has been printed is transported ahead of the first sheet S1. In this case, the first sheet S1 cannot be ejected because of the presence of the second sheet S2. More particularly, after the toner image is transferred to and fixed on the first sheet S1, the first sheet S1 is transported towards the ejection tray. The second sheet S2 located ahead of the first sheet S1 is transported towards the ejection tray until the rear end of the second sheet S2 passes over the impeller 14, and is moved back to the transport path 21 due to the reverse rotations of the rollers 16, 17 and 18.

Hence, the first sheet S1 having images printed on both sides thereof cannot be transported through the transport path 24 until second sheet S2 is completely moved back to the transport path 21. Hence, in practice, a sufficient distance is provided between the second sheet S2 and the first sheet S1 so that, after the two-sided print, the leading end of the first sheet S1 is located between the impeller 14 and the opposing roller 15 after the second sheet S2 is completely shunted to the transport path 21, as shown by a chained line S2'. Hence, when the second sheet S2 after the one-side print is located at the position indicated by a solid line, the first sheet S1 is located in the transport path and is far away from the second sheet S2. In this case, the first sheet S1 and the second sheet S2 are spaced apart from each other by a distance equal to at least the sheet length.

As described above, it is necessary to sufficiently separate the first and second sheets S1 and S2 from each other. This decreases the printing speed, and causes delay in ejection of the first sheet S1. The first sheet S1 after the two-sided print cannot be ejected rapidly, which increases the number of sheets in the apparatus and increases the possibility of jamming.

In order to eliminate the above disadvantages and eject the sheet after the two-sided print as rapidly as possible, the following method has been proposed. According to the proposed method, the second sheet S2 is transported to the transport path 21 at a speed higher than the speed at which the sheet is ejected. For this purpose, the rollers 16, 17 and 18 are reversed at a circumferential speed higher than the circumferential speed of forward rotation of the rollers 16, 17 and 18. With the above proposed method, it becomes possible to reduce the distance between the first sheet S1 and the second S2 traveling ahead thereof and to rapidly eject the first sheet S1 after the two-sided print. Further, it becomes possible to reduce the number of sheets in the apparatus and to reduce the possibility of jamming.

Another method has been proposed in which the opposing rollers 15 and 20 cooperating with the impeller 14 are omitted, and the impeller 14 is located between the fixing unit 13 and the rollers 16 positioned at the end of the ejection transport path 24 in such a manner that the impeller 14 does not have any opposing roller. With this arrangement, it is possible to obtain the difference between the ejection transport speed of the first sheet S1 and the shunting speed of the second sheet S2. The circumferential speed of the outer portion of the impeller 14 is set to be higher than the shunting speed of the second sheet S2. Thereby, the shunting transport speed of the second sheet S2 is higher than the ejection transport speed of the first sheet S1 without preventing the high-speed shunting operation of the second sheet S2.

Further, as shown by the chained line in FIG. 2, the transport roller pair 25 is located just below the impeller 14 in the transport path 21 for back-surface printing. As shown in FIG. 1, the portion of the transport path 21 between the impeller 14 and the transport rollers 22 is a downward slope in order to facilitate smooth and high-speed shunting movement. The downward slope is formed by an inclined frame 29 fastened to a base 27 by means of a supporting shaft 28.

When the two-sided printing apparatus is working, the frame 29 is maintained in the inclined state, in which the impeller 14 and the transport rollers 25 are positioned at the upper portion of the frame 29, and the transport roller 22 is located at the lower end thereof. The second sheet S2 moving from the ejection transport path 24 descends due to the transporting force generated by the rollers 25 as well as the weight of the second sheet S2. Hence, the second sheet can be more smoothly shunted to the transport path 21.

When a sheet jam takes place in the transport path 21, the frame 29 is pivoted about the axis of the shaft 28 in the direction indicated by the arrow and reaches a level position. In this manner, the inner portion of the apparatus can be easily accessed, and a jammed sheet can be easily removed.

However, if a sheet jam takes place in the back-surface transport path 21 where the second sheet S2 is transported after the front-surface printing is completed, the rollers 25, 22 and 23 are manually turned to the state where the frame is horizontally maintained. If the second sheet S2 slips or is torn during the removal operation, it will become difficult or impossible to remove the second sheet S2 from the transport path 21. If the removal of the jammed sheet is forced, the apparatus may be damaged.

SUMMARY OF THE INVENTION

It is a general object of the present invention to provide a two-sided printing apparatus in which the above disadvantages are eliminated.

A more specific object of the present invention is to provide a two-sided printing apparatus in which a sheet jammed can be easily removed from a transport path for transporting a sheet having printed images on one side thereof to an image transfer unit in order to print images on the other side thereof.

The above objects of the present invention are achieved by a two-sided printing apparatus comprising: sheet feeding means for feeding a sheet; image printing means, coupled to the sheet feeding means, for printing images on the sheet from the sheet feeding means; sheet ejecting means, coupled to the image printing means, for ejecting the sheet from the image printing means; and sheet refeeding means, coupled to the ejecting means and the image printing means, for refeeding a sheet having a first surface on which images have been printed to the image printing means in order to print images on a second surface of the sheet. The sheet refeeding means comprises a base, an inclined frame rotatably fastened to the base, a first guide member facing the inclined frame, and a second guide member facing the base. The sheet moves downwards between the inclined frame and the first guide member and moves between the base and the second guide member. The first guide member is rotatably supported so that the first guide member is lifted in a state in which the inclined frame is lowered, and a first space is formed between the inclined frame lowered and the first guide member raised. The second guide member is rotatably supported so that the second guide member can be lifted to a state in which a space is formed between the base and the second guide member raised.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 3A:
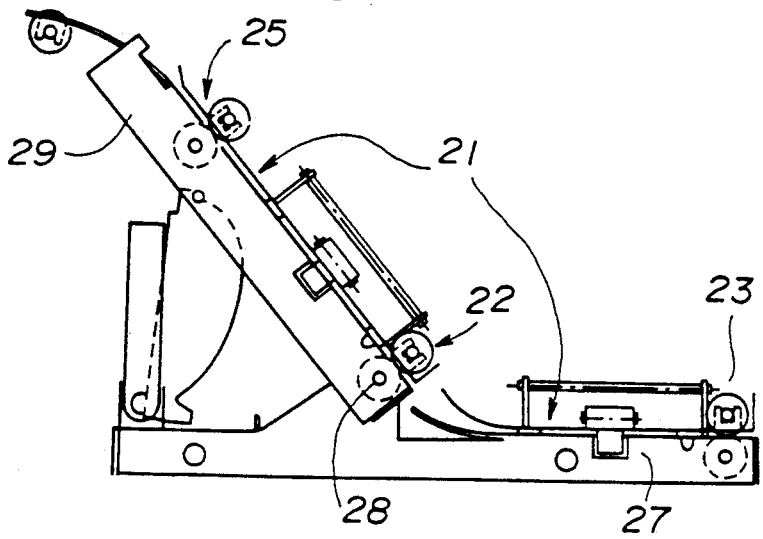
FIGS. 3A, 3B and 3C are diagrams showing an overview of an essential part of the present invention.
Figure 3B:
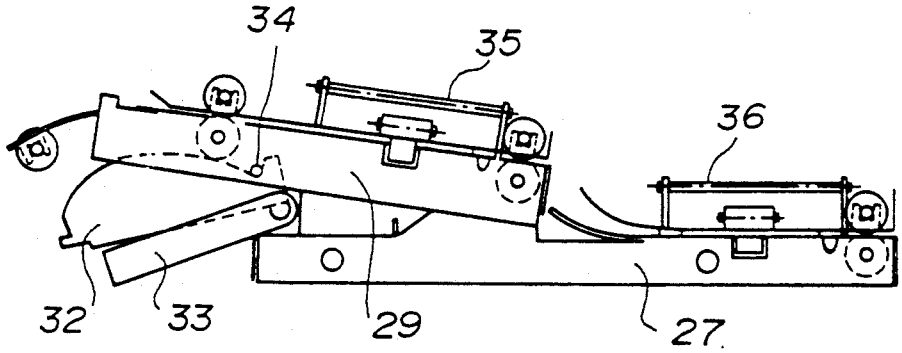
Figure 3C:
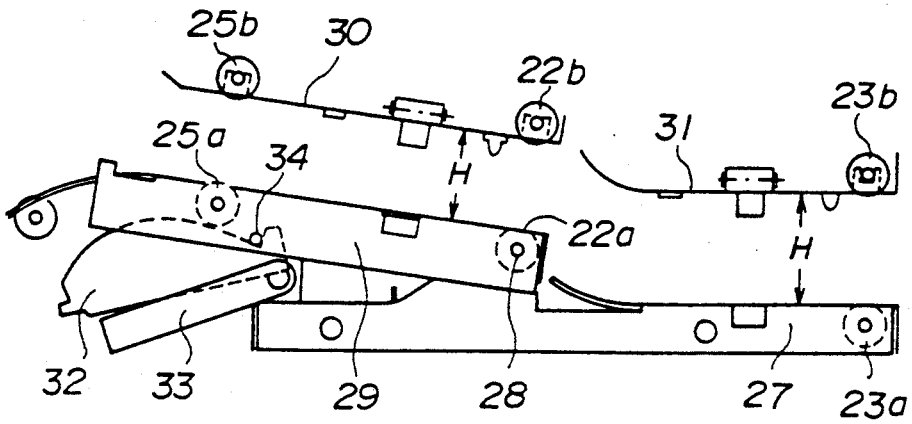

FIGS. 3A, 3B and 3C are diagrams showing an outline of a two-sided printing apparatus according to the present invention. In FIGS. 3A, 3B and 3C, parts that are the same as parts shown in the previous figures are given the same reference numbers. Images are printed on a first (front) surface of a sheet, such as paper, by means of an image transfer unit. The sheet is turned over and refed to the image transfer unit, in which images are printed on a second (back) surface thereof.

Figure 1:
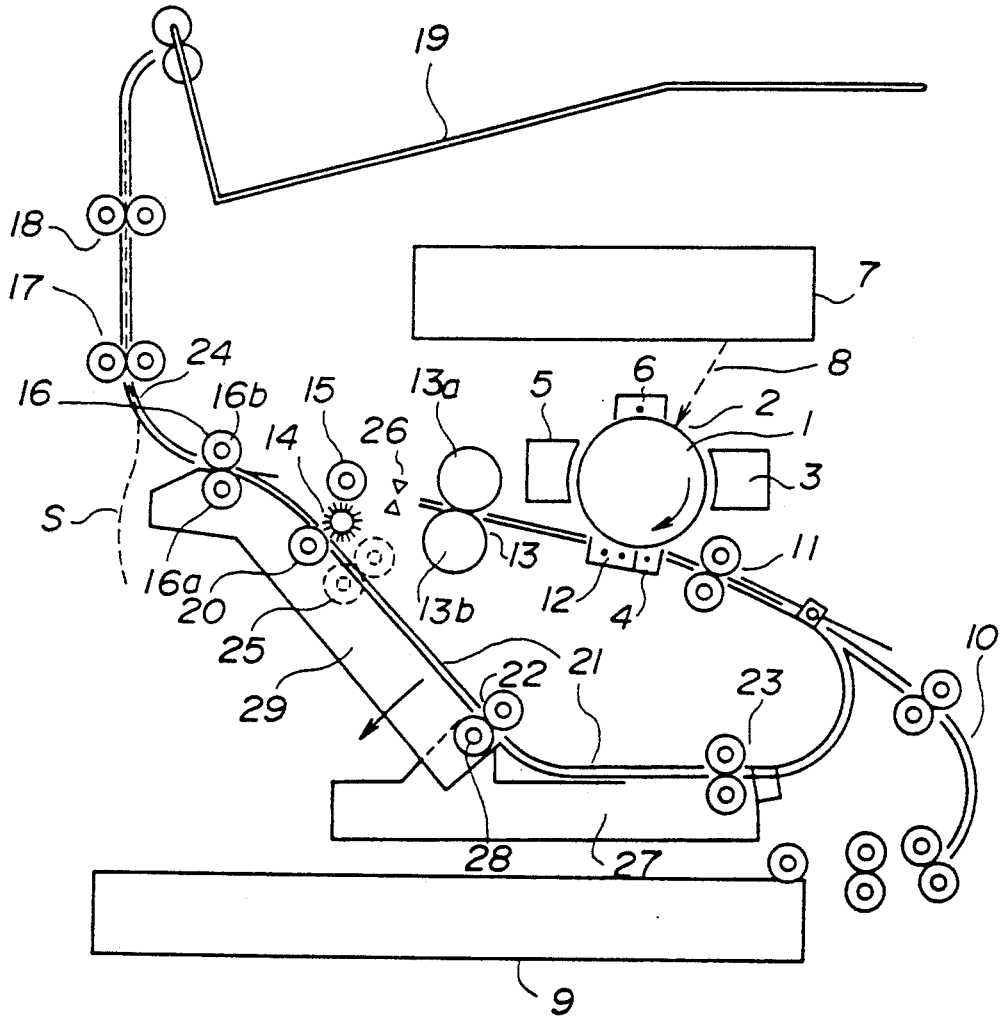
FIG. 1 is a front view of a conventional two-sided printing apparatus.
Figure 2:
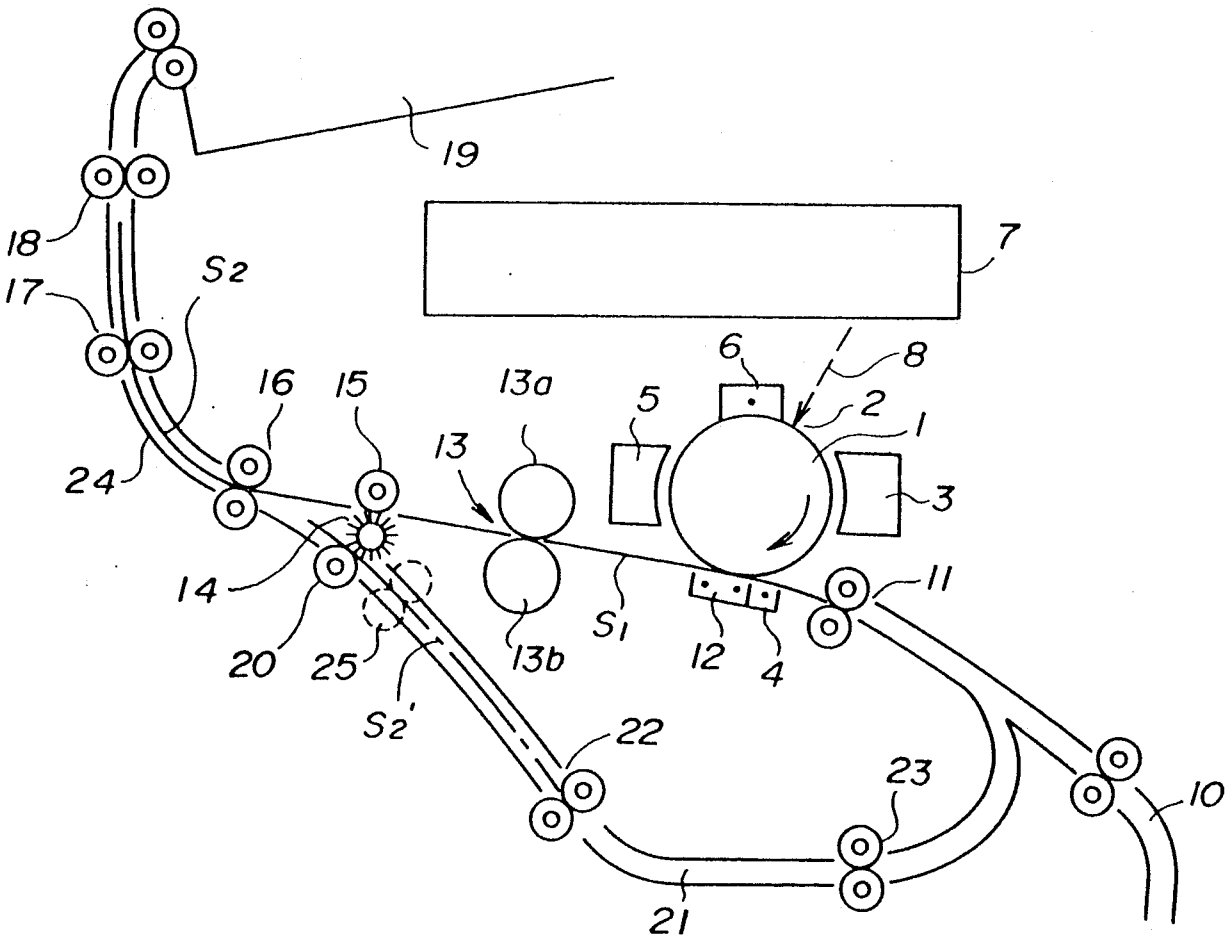
FIG. 2 is another front view of the conventional two-sided printing apparatus in order to show how sheets are transported in the apparatus.

The transport path 21 for the back surface printing comprises the base 27 and the inclined frame 29, which frame is rotatably fastened to the base 27 by the shaft 28. Guide members 30 and 31 are provided so that the base 27 and the inclined frame 29 are covered or exposed. When a jam takes place, the guide members 30 and 31 are opened such that the inclined frame 29 is maintained in an approximately level state. In this state, a space H is available between the inclined base 29 and the guide member 30, and a space H is available between the base 27 and the guide member 31. In this manner, the transport path can be opened from the front side of the apparatus, and a jammed sheet can be easily removed therefrom. As will be described in detail later, the frame 29 is maintained in the approximately level state and the guide members 30 and 31 are opened such that the frame 29 is sufficiently spaced apart from the fixing unit 13 and the ejection transport path 24 (FIG. 1). Hence, each of the space H is large enough to accommodate a hand which can easily remove the jammed sheet from the apparatus. The guide members 30 and 31 are closed after the jammed sheet is removed, and slave transport rollers **25*b*, 22*b* and 23*b* on the side of the guide members 30 and 31 are pressed against master rollers 25*a*, 22*a* and 23*a*, to which driving forces are applied. Pairs of rollers 25*a* and 25*b*, 22*a* and 22*b*, and 23*a* and 23*b*** transport the second sheet to the image transfer unit.

A cam mechanism 32 and a handle 33 are fastened to the base 27, and a cam follower 34 is provided to the frame 29. The handle 33 turns the cam mechanism 32, and the cam follower 34 slides on a curved cam surface of the cam mechanism 32. Hence, it is possible to smoothly lower and raise the frame 29.

The guide members 30 and 31 are rotatably fastened to the frame and base by means of supporting shafts 35 and 36, respectively. Hence, the guide members 30 and 31 can be pivoted around the axes of the shafts 35 and 36 toward the operator when the frame 29 is level. Hence, a large space for removing a jammed sheet can be obtained.

Figure 4:
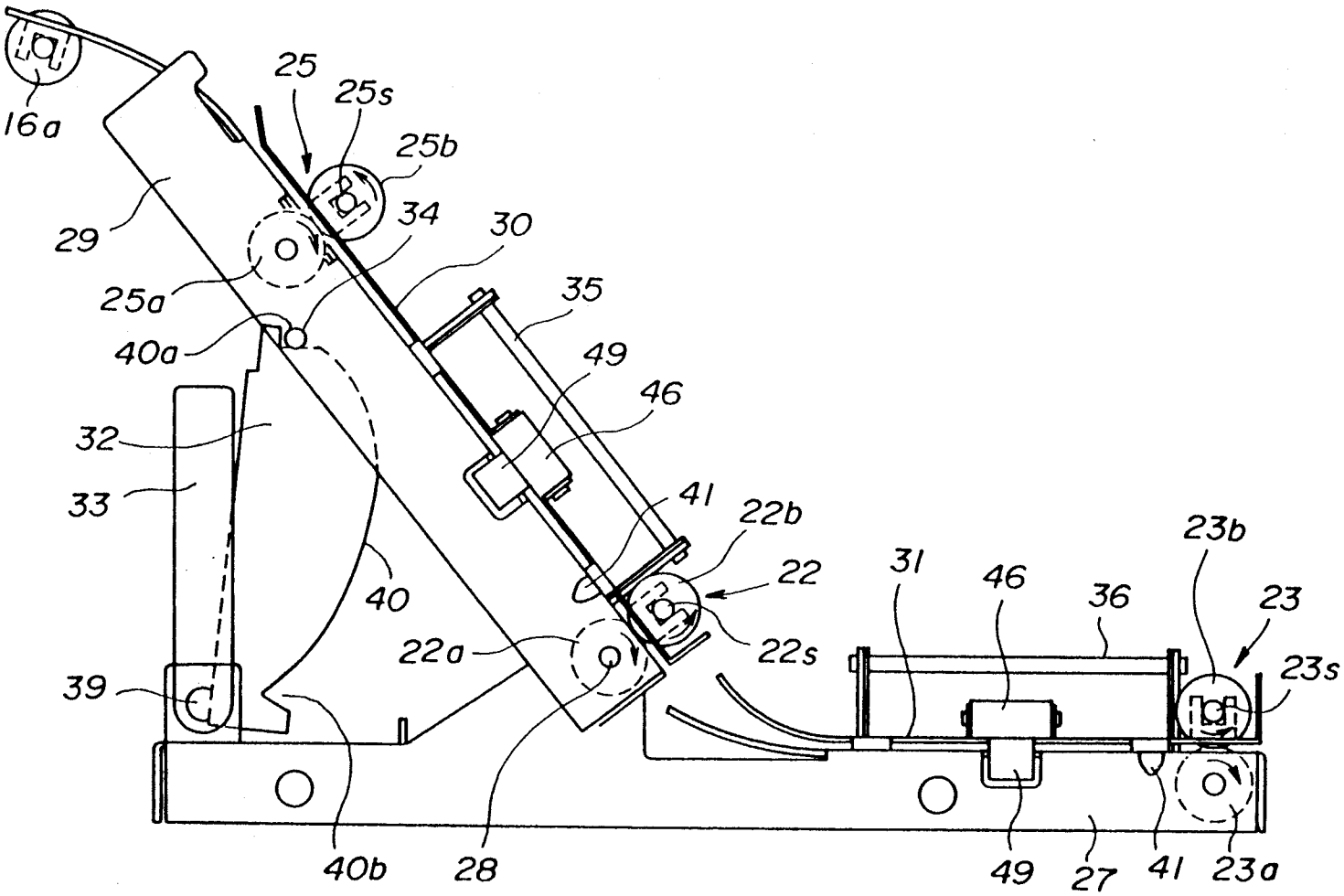
FIG. 4 is a front view of a two-sided printing apparatus according to a first embodiment of the present invention.
Figure 5A:
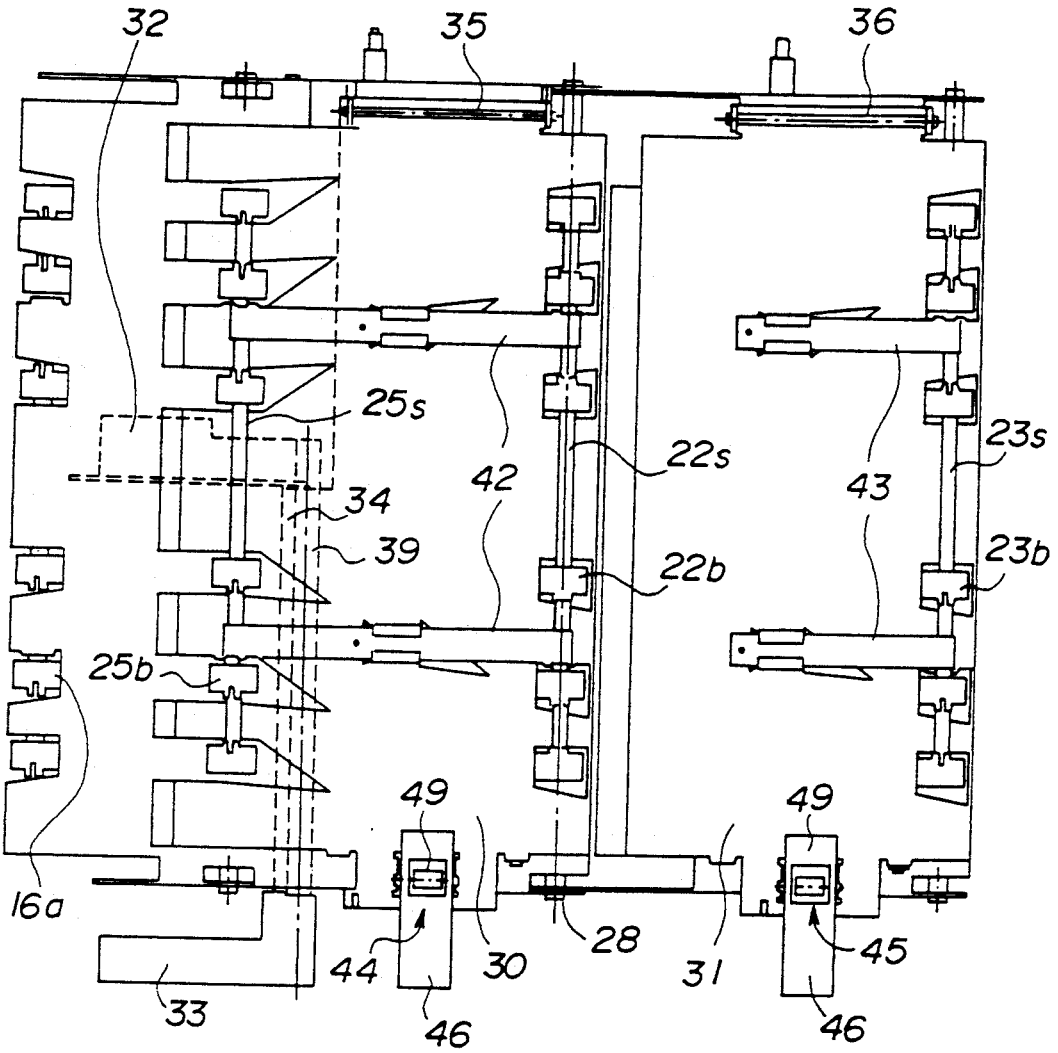
FIG. 5A is a plan view of the two-sided printing apparatus shown in FIG. 4.
Figure 5B:
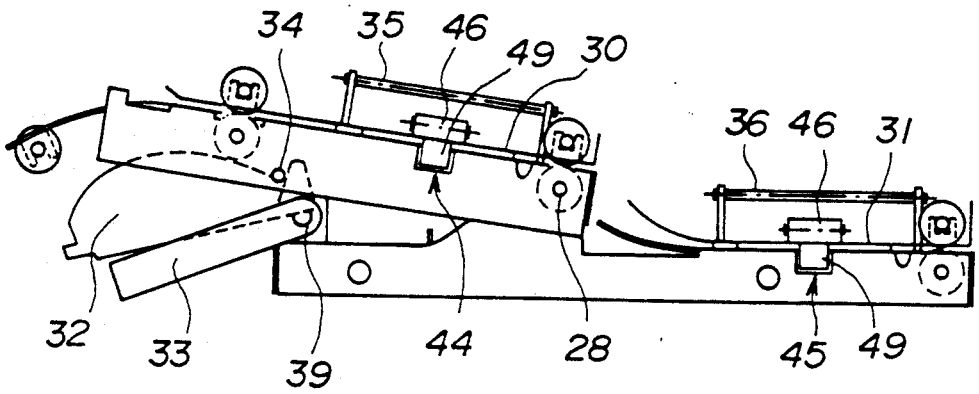
FIG. 5B is a front view of the two-sided printing apparatus shown in FIG. 4.

A description will now be given, with reference to FIGS. 4, 5A, 5B, 6A–6C, and 7A–7D, of a first embodiment of the present invention. As shown in FIGS. 4, 5A and 5B, the frame 29 is joined to the base 27 by means of the shaft 28 located at the same position as the transport roller **22*a*. The frame 29 is free to turn around the shaft 28. The cam mechanism 28 is provided for lowering and raising the frame 29. The handle 33 having a lever shape is fixed to one end of a shaft 39 fastened to the base 27 on the front side of the apparatus. At the center of the frame 29, the cam mechanism 32 is fastened to the other end of the shaft 39**.

The shaft 34 functioning as a cam follower is fastened to the frame 29. The cam follower shaft 34 slides on a cam surface 40 of the cam mechanism 32. The cam surface 40 has a curvature which functions to smoothly lowering and raise the frame 29. The cam mechanism has a cutout portion **40*a* formed at an end portion of the cam surface 40. The cam follower 34 comes into contact with a projection formed by the cutout portion 40*a*, and thereby the frame 29** is locked in an inclined state.

The rollers 25, 22 and 23 for transporting the sheet during the back-surface printing are fastened to the frame 29. The master roller **23*a* is fastened to the base 27. The slave rollers 25*b* and 22*b* are fastened to the guide member 30 on the side of the frame 29, and the slave roller 23*b* is fastened to the guide member 31 on the side of the base 27**.

As shown in FIGS. 5A and 5B, shafts **25*s* and 22*s* of the slave rollers 25*b* and 22*b* are pressed against the master rollers 25*a* and 22*a* at respective ends of leaf springs 42 fixed to the guide member 30. In this manner, the slave rollers 25*b*, 22*b* and 23*b* are pressed against the master rollers 25*a*, 22*a* and 23*a* by means of the spring forces of the leaf springs 42. A shaft 23*s* of the slave roller 23*b* is pressed against the master roller 23*a* at ends of leaf springs 43. As shown in FIG. 4, in the state in which the guide members 30 and 31 are closed, the second sheet after the front-surface printing is completed is transported by means of rotation of the rollers 25, 22 and 23** in that sequence.

In order to easily remove a jammed sheet, as shown in FIGS. 5A and 5B, the rear end of the guide member 30 is fastened to the frame 29 via a supporting shaft 35, and the rear end of the guide member 31 is fastened to the base 27 via a supporting shaft 36. An end portion of the guide member 30 on the front side of the apparatus is fixed to the frame 29 by means of a lock mechanism 44. An end portion of the guide member 31 on the front side of the apparatus is fixed to the base 27 by means of a lock mechanism 45.

Figure 6A:
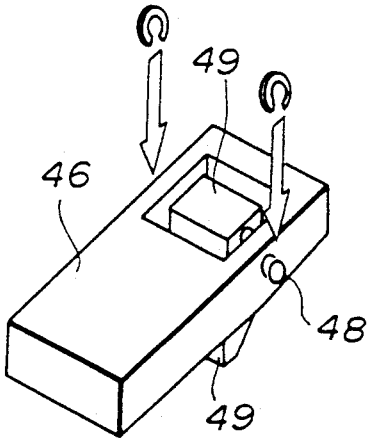
FIGS. 6A, 6B and 6C are diagrams of a lock mechanism used in the first embodiment of the present invention.
Figure 6B:
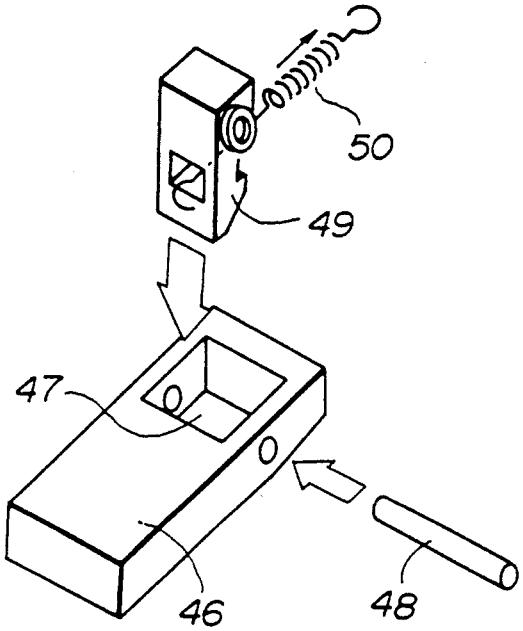
Figure 6C:
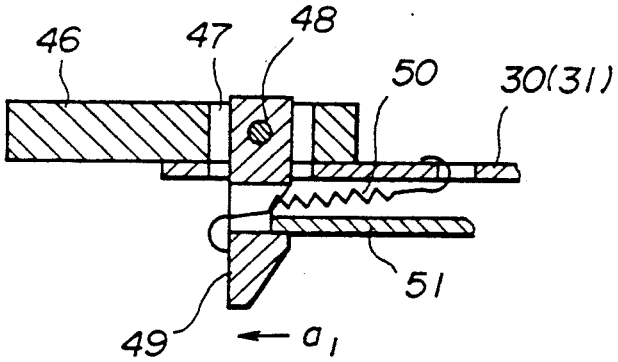

FIGS. 6A, 6B and 6C show each of the lock mechanism 44 and 45. FIG. 6A shows the assembled state of the lock mechanism, FIG. 6B shows the disassembled state thereof, and FIG. 6C is a cross-sectional view of the lock mechanism in the locked state. The lock mechanism has a knob 46, which is fixed to the guide member 30 or 31. A rotary craw 49 supported by a shaft 48 is provided in an opening 47 formed in the knob 46. The rotary craw 49 is stretched by means of a tension coil spring 50 in a direction in which the rotary craw 49 is closed.

In the state in which the guide members 30 and 31 are closed, as shown in FIG. 6C the rotary craw 49 engages an engagement plate 51 of the base 27 or the frame 29. Hence, the slave rollers **25*b*, 22*b* and 23*b* are pressed against the master rollers 25*a*, 22*a* and 23*a* by spring forces of the leaf springs 42 and 43**.

In order to open the guide members 30 and 31 for removing a jammed sheet from the apparatus, the rotary craw 49 shown in FIG. 6C is stretched toward the operator (in a direction indicated by an arrow $a_1$). Due to the function of the forces of the leaf springs 42 and 43 for pressing the slave rollers, the guide members 30 and 31 and the rotary craw 49 are moved upward. Finally, the rotary craw 49 is disengaged from the engagement plate 51. When the knob 46 is lifted in the above disengagement state, the guide members 30 and 31 are opened by rotating about the shafts 35 and 36.

Figure 7A:
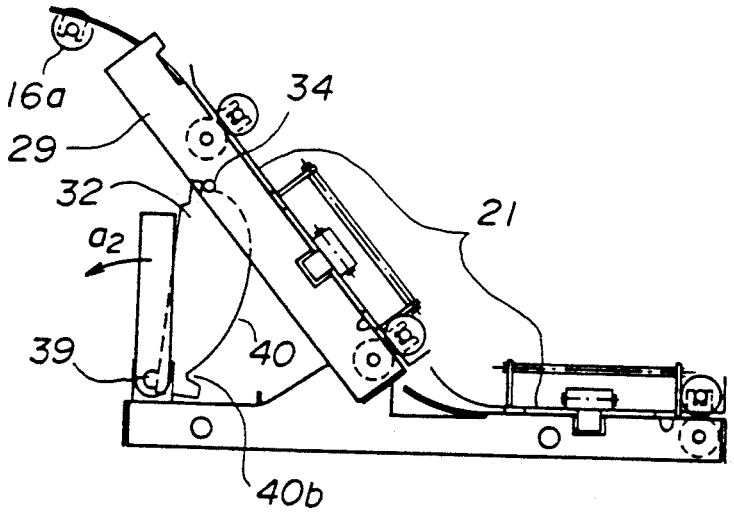
FIGS. 7A, 7B, 7C and 7D are diagrams showing how a sheet jammed in the two-sided printing apparatus according to the first embodiment of the present invention is processed.
Figure 7B:
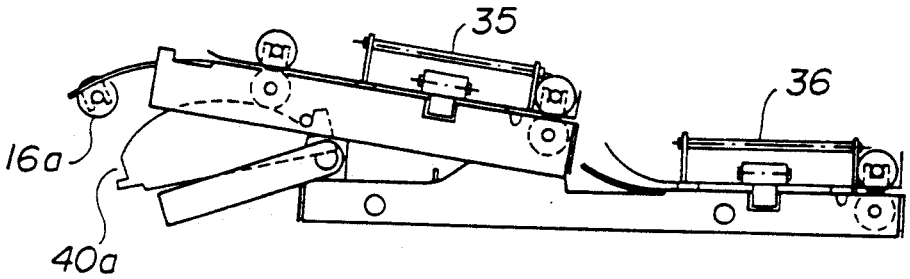

FIGS. 7A–7D show how a jammed sheet is processed. When a jam occurs in the transport path 21 for the back-surface printing, as shown in FIG. 7A the handle 33 is pulled in the counterclockwise direction indicated by an arrow $a_2$ until the cam follower 34 of the frame 29 engages the cutout portion **40*a* formed at the end of the cam mechanism 32. In response to the above operation, the cam mechanism 32 starts to rotate about the shaft 39 in the counterclockwise direction. At this time, the cam follower 34 slides on the curved cam surface 40, and thereby the frame 29 gradually descends. Then, as shown in FIG. 7B, the cam follower 34** engages the cutout portion 40*b* of the cam mechanism 32 and is fixed in the engagement state.

When the frame 29 is maintained in the approximately level state, a space is available between the frame 29 and the ejection transport path 24 (FIG. 1). The master roller 16*a* located at the downstream side of the transport path 24 descends together with the frame 29. As shown in FIG. 1, a sheet S jammed in the ejection transport path 24 hangs down therefrom, and can be easily removed.

Figure 7C:
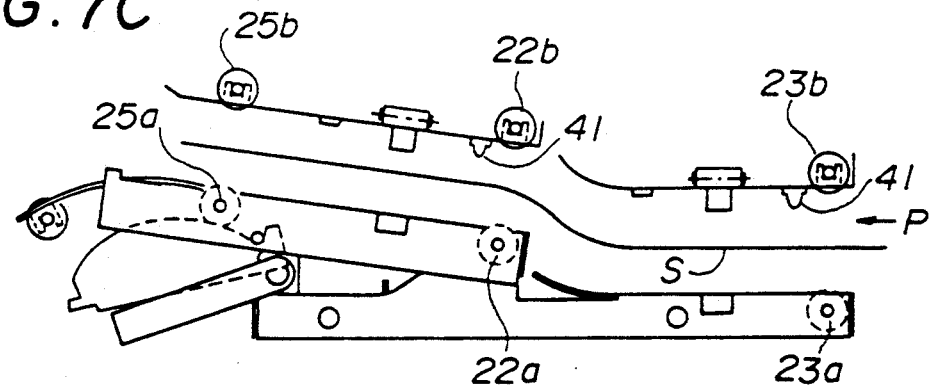
Figure 7D:
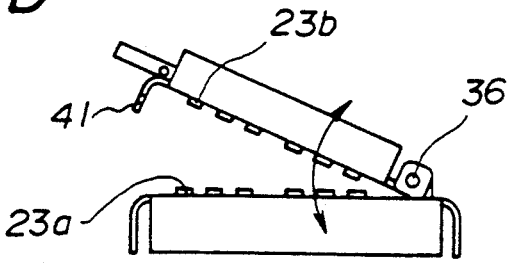

In order to remove a sheet jammed in the transport path 21 for the back-surface printing, the rotary craws 49 of the lock mechanisms 44 and 45 are respectively disengaged from the engagement plates 51, and the knobs 46 are lifted up. As shown in FIG. 7C, the guide members 30 and 31 pivot upwards about the shafts 35 and 36. In this manner, the guide members 30 and 31 are separated from the frame 29 and the base 27, respectively, and the aforementioned spaces H are formed therebetween. Hence, the jammed sheet can be easily pulled toward the operator.

After the jammed sheet is removed from the transport path 21, the guide members 30 and 31 are moved until the rotary craws 49 engage the respective engagement plates 51. Projections 41 of the respective guide members 30 and 31 are respectively inserted into positioning holes formed in the frame 29 and the base 27. In this manner, the master rollers 25*a*, 22*a* and 23*a* are positioned with respect to the slave rollers 25*b*, 22*b* and 23*b*.

It should be noted that in some cases, one of the two knobs 46 may be operated in order to remove a jammed sheet from the transport path 21. When a sheet is jammed over the frame 29 and 27, both the knobs 46 should be operated. This does not have good operationability. A second embodiment of the present invention, which will be described below, is intended to overcome the above poor operationability by employing a mechanism in which the guide members 30 and 31 are interlinked with each other.

Figure 8:
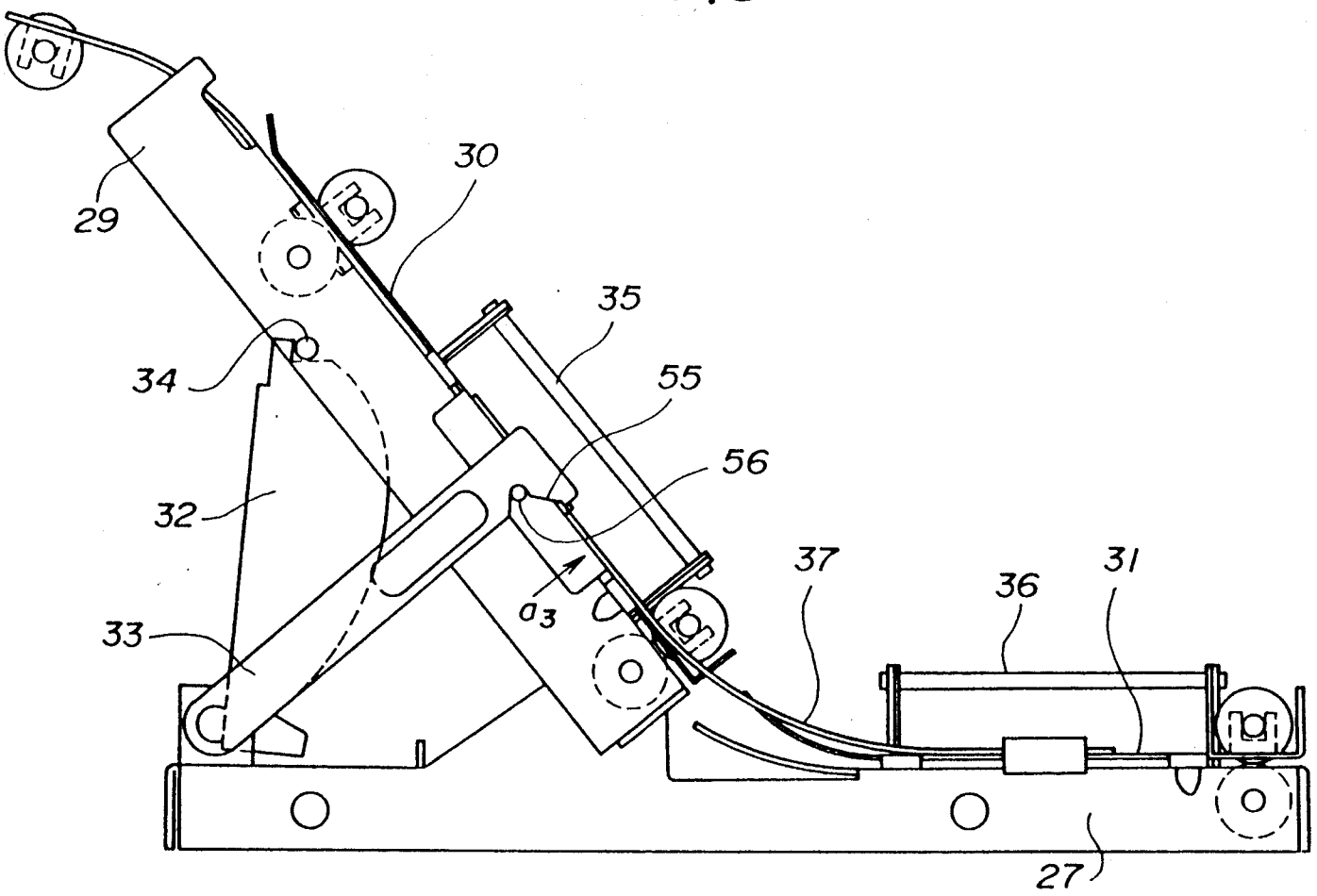
FIG. 8 is a front view of a two-sided printing apparatus according to a second embodiment of the present invention.
Figure 9A:
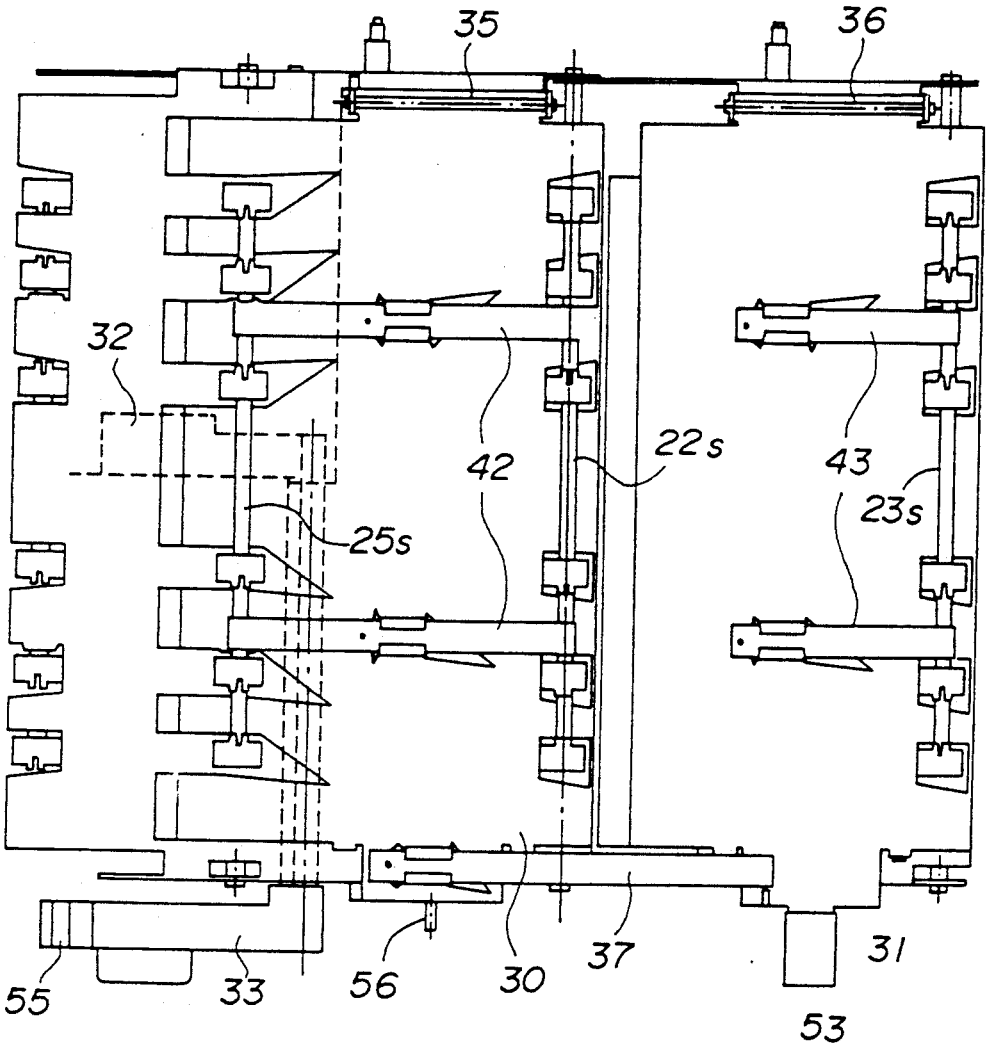
FIG. 9A is a plan view of the two-sided printing apparatus shown in FIG. 8.
Figure 9B:
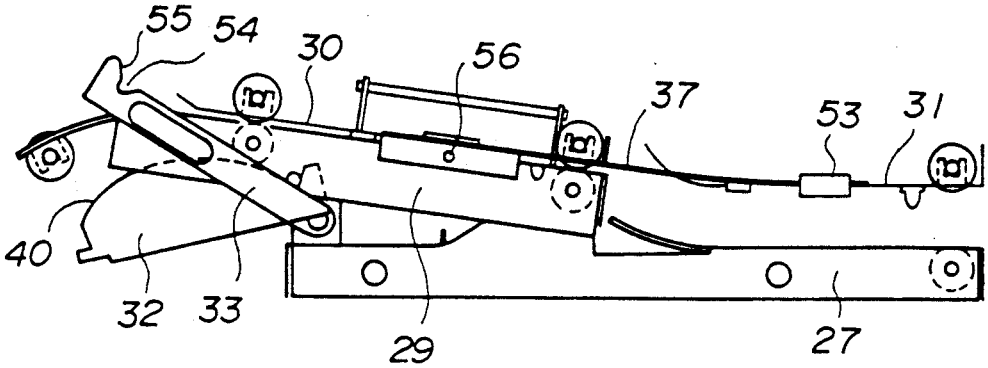
FIG. 9B is a front view of the two-sided printing apparatus shown in FIG. 8.

FIGS. 8, 9A and 9B shows the second embodiment of the present invention. In FIGS. 8, 9A and 9B, parts that are the same as parts shown in the previously described figures are given the same reference numbers. A spring member 378 formed with a leaf spring extends in the sheet transporting direction in the front of the guide members 30 and 31. A left-hand end of the leaf spring 37 is fixed to an upper front surface portion of the guide member 30 on the side of the frame 29, and a right-hand end thereof is fixed to an upper front surface portion of the guide member 31 on the side of the base 27. As shown in FIG. 9B, when the guide member 31 related to the base 27 is lifted by means of a knob 53 fastened to the guide member 31 in the frame's lowered state, the leaf spring 37 is also lifted. As a result, the guide member 30 is also lifted. In this manner, by operating only the knob 53 by one hand, both the guide members 30 and 31 are lifted and a jammed sheet can be removed by the other hand. Further, the structure of the second embodiment is simpler than that of the first embodiment, and needs a smaller number of parts.

As shown in FIG. 7B. when the cam mechanism 32 is turned by means of the handle 33 to hence raise the frame 29 from the lowered state, the guide member 31 is pressed against the base 27 by the leading end of the leaf spring 37. Hence, a problem which may be encountered in the first embodiment can be completely eliminated. If the guide members 30 and 31 in the first embodiment are not sufficiently pressed until the craws 49 completely engage the engagement plates 51, the sheet transporting operation will not be done well.

A right-hand end of the leaf spring 37 depresses the guide member 31, and the guide frame 30 may lift in a reaction to the depressing. In order to prevent the above problem, a locking recess 54 is formed in the leading end of the handle 33, and a slope guide 55 is formed between the recess 54 and the leading end of the handle 33. At the final stage of the operation in which the cam mechanism 32 is turned by the handle 33 and thereby the frame 29 is raised, a pin 56 projecting from the sidewall of the frame engages the slope guide 55. By continuing to turn the handle 33, the pin 56 is guided by the slope guide 55 and falls into the recess 54. During the above operation, the guide member 30 is pressed against the frame 29 against the lifting force of the leaf spring 37 exerted in a direction indicated by an arrow $a_3$.

In the above manner, the guide member 30 on the side of the frame 29 is automatically closed at the final stage of the operation in which the frame 29 is raised by means of the handle 33. It will be noted that the second embodiment does not require closing of the guides 30 and 31 or detachment of the rotary craws 49 from the respective engagement plates 51.

Figure 10:
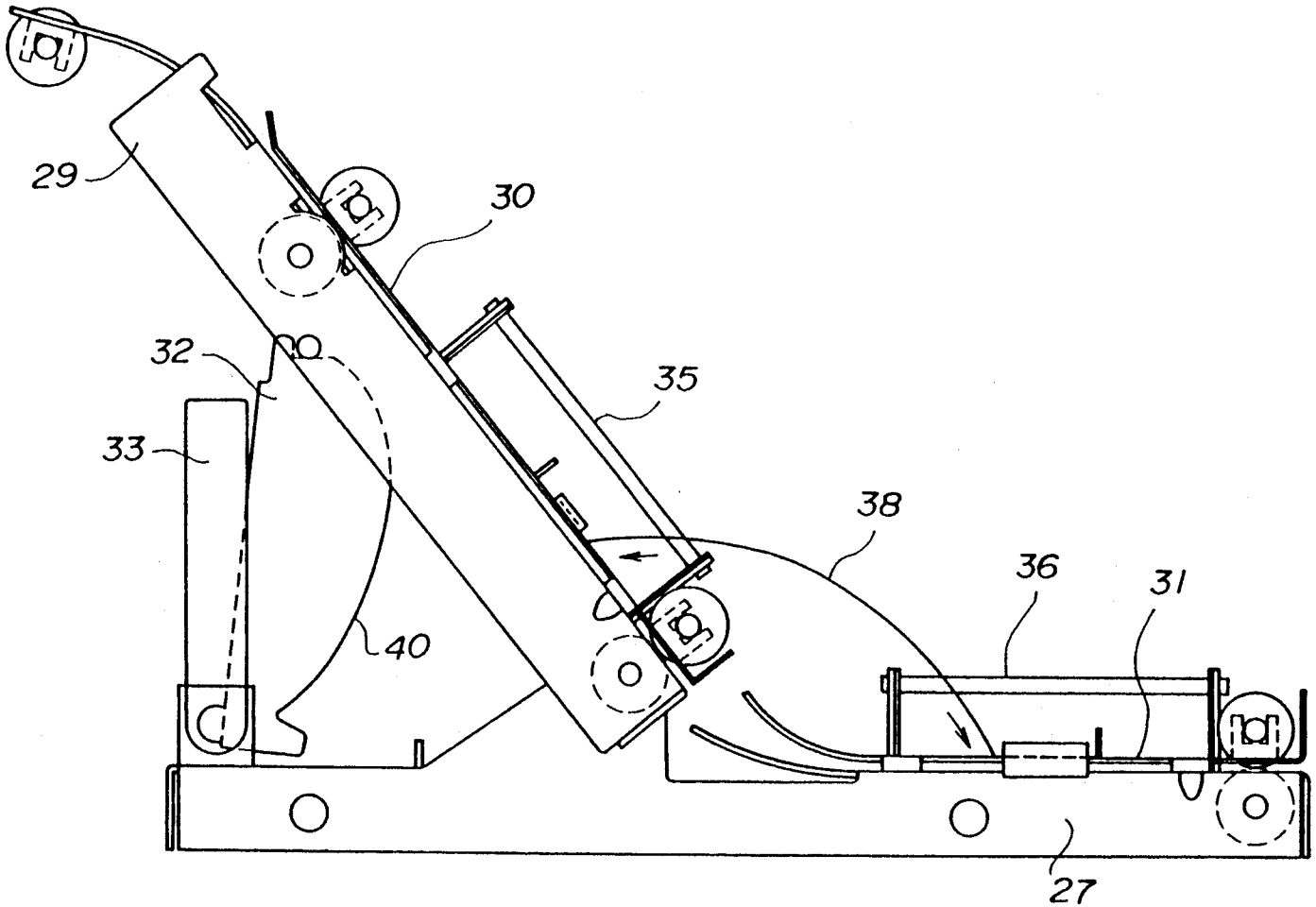
FIG. 10 is a front view of a two-sided printing apparatus according to a third embodiment of the present invention.
Figure 11A:
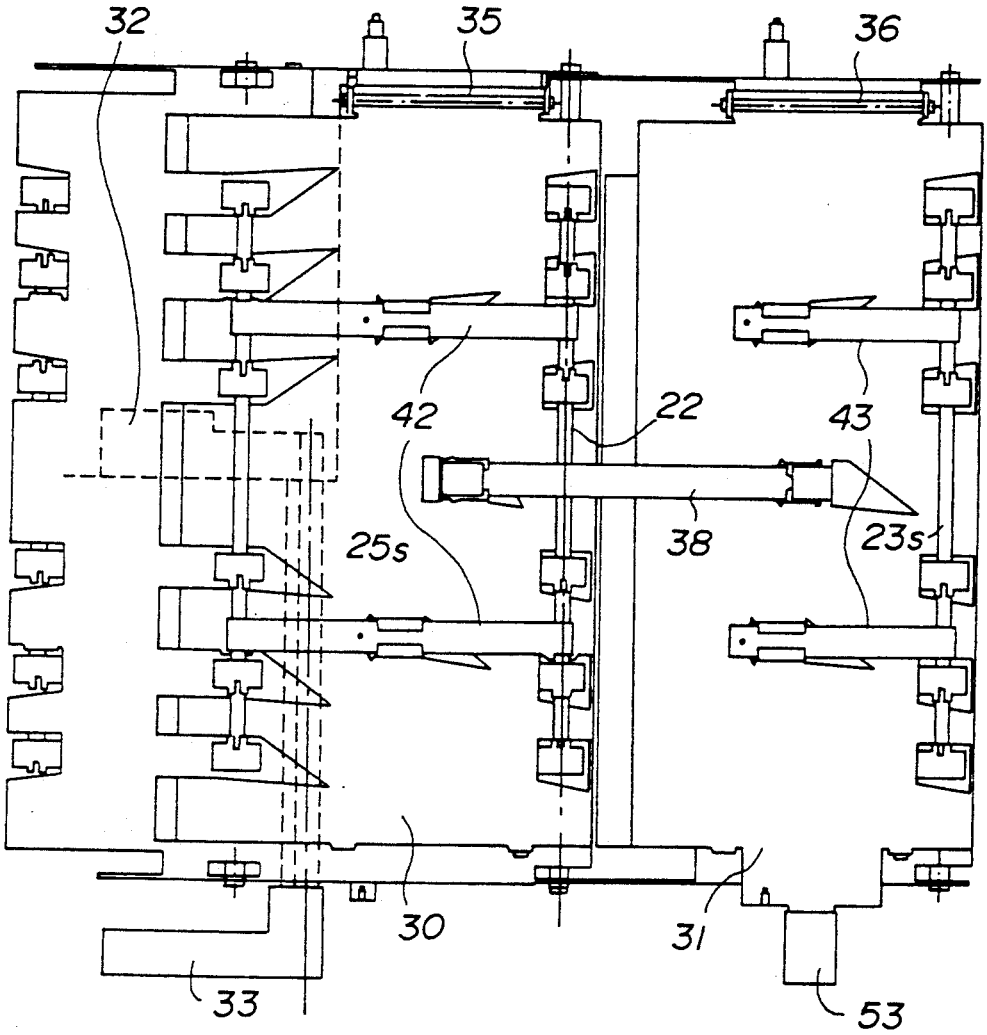
FIG. 11A is a plan view of the two-sided printing apparatus shown in FIG. 10.
Figure 11B:
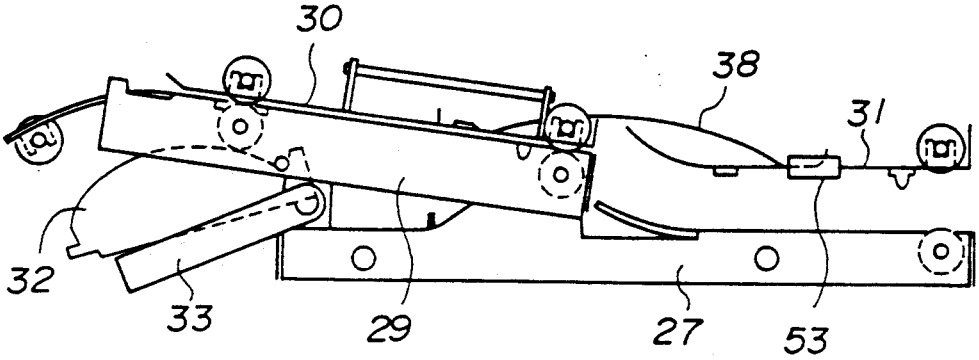
FIG. 11B is a front view of the two-sided printing apparatus shown in FIG. 10.

A description will now be given, with reference to FIGS. 10, 11A and 11B, of a third embodiment of the present invention in which the lifting of the guide member 30 can be prevented without the recess 54 and the slope guide 55. In FIGS. 10, 11A, and 11B, parts that are the same as parts shown in the previous figures are given the same reference numbers.

A spring member 38 is attached between the guide member 30 on the side of the frame 29 and the guide member 31 on the side of the base 27. The spring member 38 generates a spring force exerted in a direction such that the frame 29 is pushed down. The spring member 38 is formed with a leaf spring which is curved upwards. The right-hand end of the leaf spring 38 is fixed to an upper surface portion of the guide member 31, and a left-hand end thereof is fixed to an upper surface portion of the guide member 30. As shown in FIGS. 11A and 11B, when the knob 53 fastened to the guide member 31 is lifted, the guide member 30 is also lifted together with it. A sheet jammed below the guide members 30 and 31 can be easily removed from the transport path 21. The leaf spring 38 is gradually deformed when the cam mechanism 32 is turned by the handle 33 and the frame 29 is raised from the lowered state along the cam surface 40. The stress of the leaf spring 38 gradually increases, pressing the guide member 30 and 31 against the frame 29 and the base 27, respectively without a specific operation. That is, the lock releasing operation and the guide closing operation are not needed. Further, the leaf spring 37 for preventing the guide member from lifting is not needed because the leaf spring 38 presses the guide member 30 against the frame 29.

The present invention is not limited to the specifically disclosed embodiments, and variations and modifications may be made without departing from the scope of the present invention. For example, the leaf springs can be replaced by a torsion spring.

What is claimed is:

1. A two-sided printing apparatus comprising:

sheet feeding means for feeding a sheet;

image printing means, coupled to said sheet feeding means, for printing images on the sheet from said sheet feeding means;

sheet ejecting means, coupled to said image printing means, for ejecting the sheet from the image printing means; and sheet refeeding means, coupled to said ejecting means and said image printing means, for refeeding a sheet having a first surface on which images have been printed to said image printing means in order to print images on a second surface of said sheet, said sheet refeeding means comprising a base, an inclined frame rotatably fastened to said base so that the inclined frame is maintained in an inclined state for printing operation a lowered state for maintenance, a first guide member facing the inclined frame, and a second guide member facing the base, the sheet moving downwards between the inclined frame and the first guide member and moving between the base and the second guide member, the first guide member being rotatably supported so that the first guide member is rotatably raised in a state in which the inclined frame is lowered, and a first space is formed between the inclined frame lowered and the first guide member raised, the second guide member being rotatably supported so that the second guide member is rotatably raised in a state in which a space is formed between the base and the second guide member raised, and a first direction about which the inclined frame is rotatably moved being different from a second direction about which said first and second guide members are rotatably moved.

2. The tow-sided printing apparatus as claimed in claim 1, wherein:

the inclined frame comprises a first shaft which rotatably supports the first guide member; and the inclined frame comprises a second shaft which rotatably supports the second guide member.

3. The two-sided printing apparatus as claimed in claim 1, wherein said first and second shafts extend in a direction in which the sheet is transported to said image printing means by said sheet refeeding means.

4. The two-sided printing apparatus as claimed in claim 1, further comprising:

first lock means for engaging the first guide member with the inclined frame; and second lock means for engaging the second guide member with the base.

5. The two-sided printing apparatus as claimed in claim 1, further comprising:

a cam mechanism which is fastened to said base and has a curved surface;

a handle which is fastened to said base and cooperates with said cam mechanism; and a cam follower which is fastened to said inclined frame and slides on said cam surface, said inclined frame being, in response to an operation of said handle, raised by rotating around a supporting portion at which the inclined frame is rotatably supported by the base.

6. The two-sided printing apparatus as claimed in claim 1, further comprising a spring member coupling said first guide member and said second guide member with each other.

7. The two-sided printing apparatus as claimed in claim 6, wherein:

the inclined frame comprises a first shaft which rotatably supports the first guide member;

the inclined frame comprises a second shaft which rotatably supports the second guide member; and said spring member extends in parallel with the first and second shafts.

8. The two-sided printing apparatus as claimed in claim 7, further comprising a knob fastened to one of the first and second guide members, said one of the first and second guide members being raised in response to an operation of said knob, and the other one of the first and second guide members connected to said one of the first and second guide members by said spring member being also raised together.

9. The two-sided printing apparatus as claimed in claim 6, wherein said spring member is fixed to the first guide member, and presses said second guide member by means of a spring force of said spring member.

10. The two-sided printing apparatus as claimed in claim 5, wherein said handle comprises lock means for maintaining said inclined frame in the inclined state.

11. The two-sided printing apparatus as claimed in claim 5, further comprising a spring member coupling said first guide member and said second guide member with each other.

12. The two-sided printing apparatus as claimed in claim 11, wherein:

the inclined frame comprises a first shaft which rotatably supports the first guide member;

the inclined frame comprises a second shaft which rotatably supports the second guide member; and said spring member extends in parallel with the first and second shafts.

13. The two-sided apparatus as claimed in claim 12, further comprising a knob fastened to one of the first and second guide members, said one of the first and second guide members being raised in response to an operation of said knob, and the other one of the first and second guide members connected to said one of the first and second guide members by said spring member being also raised together.

14. The two-sided printing apparatus as claimed in claim 11, wherein said spring member is fixed to the first guide member, and presses said second guide member by means of a spring force of said spring member.

15. The two-sided printing apparatus as claimed in claim 1, further comprising a spring member provided between said first guide member and said second guide member, said spring member generating a force exerted so that said inclined frame is pushed down.

16. The two-sided printing apparatus as claimed in claim 5, further comprising a spring member provided between said first guide member and said second guide member, said spring member generating a force exerted so that said inclined frame is pushed down.

* * * * *

UNITED STATES PATENT AND TRADEMARK OFFICE

CERTIFICATE OF CORRECTION

PATENT NO. : 5,233,401

DATED : Aug. 3, 1993

INVENTOR(S) : SASAKI et al.

It is certified that error appears in the above-indentified patent and that said Letters Patent is hereby corrected as shown below:

Col. 2, line 6, after "back" insert --surface reaches the photosensitive drum 1 in the--;
line 9, after "image" insert --is--;
line 12, after "16," insert --17,--.

Col. 5, line 24, change "space" to --spaces--;
line 62, change "lowering" to --lower--.

Col. 9, line 15, after "operation" insert --and in--;
lines 18-19, delete the paragraph break;
line 35, change "tow" to --two--.

Signed and Sealed this

Thirteenth Day of September, 1994

*Attest:*

*Attesting Officer*

BRUCE LEHMAN

*Commissioner of Patents and Trademarks*